US005535282A

United States Patent [19]

Luca

[11] Patent Number: 5,535,282

[45] Date of Patent: Jul. 9, 1996

[54] IN-THE-EAR HEARING AID

[75] Inventor: Racca Luca, Genoa, Italy

[73] Assignee: Ermes S.r.l., Genoa, Italy

[21] Appl. No.: 445,956

[22] Filed: May 22, 1995

[30] Foreign Application Priority Data

May 27, 1994 [IT] Italy ..... GE94A0067

[51] Int. Cl.[6] ..... H04R 25/00

[52] U.S. Cl. ..... 381/68.6; 381/69

[58] Field of Search ..... 381/68.6, 68, 69, 381/23.1, 187, 154, 188, 159, 205; 181/129, 130, 135, 137

[56] References Cited

U.S. PATENT DOCUMENTS 3,470,328 9/1969 Daniels ..... 381/68.6

4,800,982 1/1989 Carlson ..... 381/68.6

*Primary Examiner*—Curtis Kuntz

*Assistant Examiner*—Sinh Tran

*Attorney, Agent, or Firm*—Larson and Taylor

[57] ABSTRACT

An in-the-ear hearing aid is formed by an ogival body (1) which is meant to be removably inserted into the acoustic meatus of the external ear, and inside the ogival body (1) there being accommodated a microphone (2) communicating (3) with the external environment; an amplifier (4) being connected to the microphone (2); an electro-acoustic transducer (5), also called a receiver, connected to the output of the amplifier (4) and communicating with the duct (401, 501) having one opening at the internal end of the ogival body (1); and a housing for one or more piles or batteries for the hearing aid electric power. The electro-acoustic transducer (5) communicates with a branched duct (501) branched off a longitudinal through duct (401) with its one end debouching at the external end of the ogival body (1) and with its other end debouching at the internal end thereof, which ducts are so provided that any cerumen and any further possibly occurring liquid secretions of the ear are not allowed to get into the branched duct (501) or reach the electro-acoustic transducer (5).

13 Claims, 2 Drawing Sheets

IN-THE-EAR HEARING AID

FIELD OF THE INVENTION

The invention concerns an in-the-ear hearing aid formed by an ogival body which is meant to be removably inserted into the acoustic meatus of the external ear, with its apex turned inwardly and with its opposite, particularly cut off end turned outwardly, and inside the ogival body there being accommodated a microphone communicating with the external environment across the external side of the ogival body; an amplifier, with its input connected to the microphone; an electro-acoustic transducer, also called a receiver, connected to the amplified output of the amplifier and communicating with a duct having its outlet at the internal end of the ogival body; and a housing for one or more piles or batteries for the hearing aid electric power.

REFERENCE DEFINITION

In the following, the terms internal and external refer to the hearing aid in the inserted condition into the acoustic meatus and in connection with a user's head in its upright position.

BACKGROUND OF THE INVENTION

Cerumen is presently the main cause of damages to, or of a malfunctioning of, an in-the-ear hearing aid. Indeed the duct communicating with the receiver is directed with a substantially straight course towards the internal end of the ogival body and substantially parallel to the acoustic meatus. Thus cerumen may easily get into the duct. While it is possible, on the one hand, to obviate any occlusion which may occur in the duct by periodically disassembling the hearing aid and removing any cerumen therefrom, it is impossible, on the other hand, to protect the receiver against the chemical action of cerumen which produces irreversible damages. Particularly for the users of in-the-ear hearing aids, also the action due to liquid secretions having various causes, such as a simple cold, an otitis, an allergy and increased sweating promoted by an occlusion of the acoustic meatus owing to the presence of the hearing aid, adds to the action of cerumen. Thus, the mean life of the receiver, which under normal conditions ranges between six months and one year, is presently reduced to a few days or a few weeks, despite the various attempts to obviate the disadvantages, such as, for example, by the provision of small grids at the outlet of or within the duct communicating with the receiver or of a small hole provided between the receiver and the outlet of the apparatus.

SUMMARY OF THE INVENTION

The objects of the invention therefore are to improve an in-the-ear hearing aid of the kind as described at outset, so as to obviate the aforementioned disadvantages by a simple and inexpensive arrangement as well as to improve not only the mean life of the receiver but at the same time also the way of functioning of the hearing aid.

The invention achieves the objects by an in-the-ear hearing aid, in which the receiver communicates with a second duct branched off the longitudinal through duct with its one end debouching at the external end of the ogival body and with its other end at the internal end thereof, which ducts are so provided that any cerumen and any further possibly occurring liquid secretions are not allowed to get into the branched duct or reach the receiver.

Advantageously the branched duct which communicates with the receiver is branched in the upward direction off from the upper side of the longitudinal through duct. More particularly the longitudinal through duct is provided in the lower region of the ogival body.

According to a further feature, the branched duct communicating with the receiver is inclined relative to the axis of the longitudinal through duct in the direction of the internal end of the ogival body and the receiver is turned toward the external side of the body itself.

Thanks to these measures, any cerumen and any different liquid secretions cannot reach the receiver in any way, whereby the danger of a chemical action on the receiver is effectively avoided. In the case of an occlusion, the longitudinal through duct can be perfectly cleaned, for example, by means of a small brush or the like. The inclination of the branched duct toward the internal end of the ogival body, with reference to the axis of the longitudinal through duct, allows the small brush, when being inserted into the longitudinal through duct from the internal end of thereof and pushed toward the opposite end of this duct, to avoid driving of the cerumen into the branched duct.

The longitudinal through duct also constitutes a duct for the acoustic waves coming directly from the external environment to be mixed with the acoustic waves being amplified by the hearing aid. Moreover this duct may also form a resonance chamber, whose characteristic frequency of resonance is variable or adjustable.

Other features further improving the above described in-the-ear hearing aid also form objects of the invention and are discussed subsequently.

BRIEF DESCRIPTION OF THE DRAWINGS

The particular features of the invention and the advantages deriving therefrom will appear more in detail from the description of some preferred embodiments, which are shown as non limiting examples in the annexed drawings, in which.

DETAILED DESCRIPTION OF THE PREFERRED EMBODIMENTS

Figure 1:
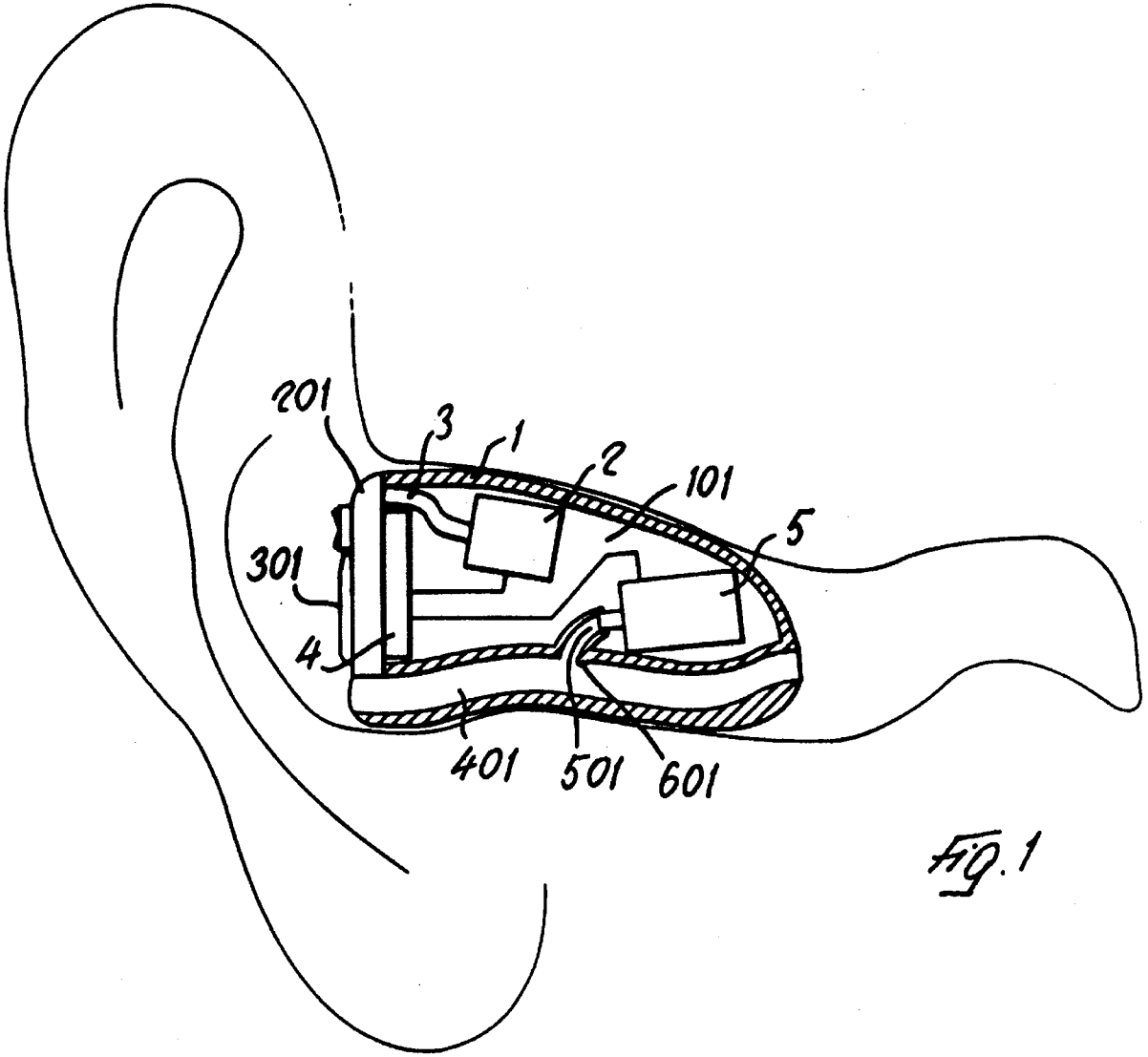
FIG. 1 shows an axial section of an in-the-ear hearing aid according to the invention inserted into the acoustic meatus of a user's ear.
Figure 2:
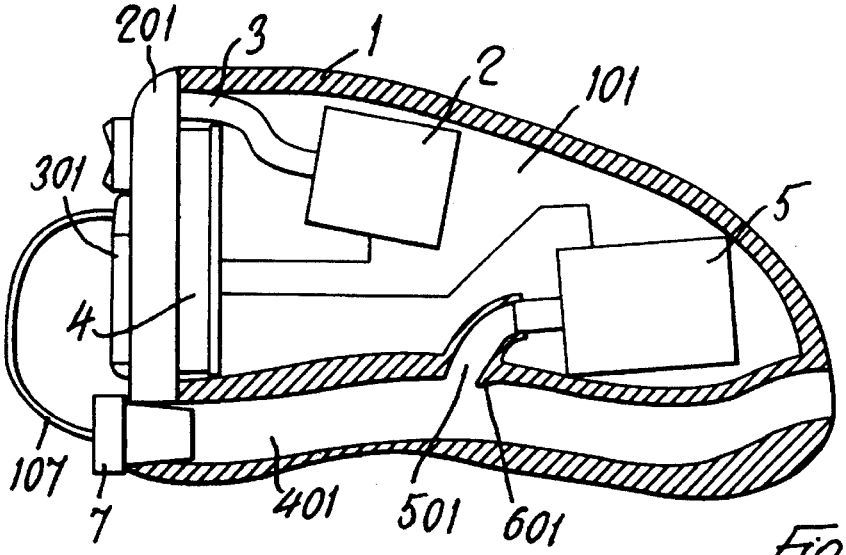
FIG. 2 shows an axial cross-section of a hearing aid similar to that one of FIG. 1, with means for closing the longitudinal through duct at its external end.

Referring to the Figures, a in the ear hearing aid is formed by an ogival body 1 which is meant to be removably inserted into the acoustic meatus of a user's ear. The outside of the ogival body 1 has a shape which corresponds to the anatomy of the acoustic meatus. The personalized construction of this body is achieved by means of suitable moulds which are shaped on the user's ear and by means of reproduction techniques usually applied also to other medical fields. The ogival body may be made of any suitable material and is inserted into a user's ear so as to have its end corresponding to the apex of the ogival body turned toward the eardrum, and its opposite cut off end turned outwardly.

The ogival body 1 is completely hollow and comprises a chamber 101 in which is accommodated a microphone 2 communicating with the outside through a duct 3. The duct 3 debouches at the external end of the body 1. The microphone 2 is connected to the input of an amplifier-circuit 4 which is advantageously fitted to the inner wall at the external end of the ogival body 1 in an adjoining relation with a housing (not shown in detail) for a powering micro-battery. The housing for the micro-battery is provided in the end wall 201 at the external end of the ogival body 1 and in the Figures only the cover 301 for closing the housing at its outward side is visible. The acoustic waves are captured by the microphone 2 and are transformed into electric signals which are amplified and transmitted to an electro-acoustic transducer 5, also called a receiver, which transforms the amplified electric signals again into acoustic waves and which is connected to the amplified output of the amplifier 4. The electro-acoustic transducer 5 is arranged over a duct 401 which extends along the lower region of the ogival body 1 and is separated from the chamber 101 in which the microphone 2, the amplifier 4 and the transducer 5 are accommodated. The duct 401 extends in the longitudinal direction of the ogival body 1 and on one side opens at the external end and on the other side at the internal end, i.e. at the apex, of the ogival body 1. In the apex area, the longitudinal through duct 401 opens substantially in a median position with respect to the ogival body 1 and to the cross-section of the acoustic meatus, i.e. radially apart from the walls thereof. The longitudinal through duct 401 has an undulated, approximately sinusoidal, shape in the vertical plane, the end section of the duct at the internal end of the ogival body 1 presenting a concave depression, and the end section of the duct at the external end of the ogival body 1 being formed by a substantially straight segment, and intermediatly between these two end sections a buckle is provided, at the top of which a branched duct 501 is branched in the upward direction off the upper side of the duct 401 and is set in communication with the electro-acoustic transducer 5. The branched duct 501 is inclined relative to the axis of the longitudinal through duct 401, in the direction of the internal end of the ogival body 1. The branched duct 501 is slightly arcuated toward the longitudinal through duct 401, and the axis of its end connected to the electro-acoustic transducer 5 forms an angle with the axis of the longitudinal through duct 401 which is more acute than the angle at its end branched off therefrom. The electro-acoustic transducer 5 is oriented in the opposite direction to the direction of transmission of the acoustic waves to the eardrum, i.e. toward the external end of the ogival body 1.

Cerumen and any other possibly occuring liquid secretions, such as sweat or secretions of different natures, accumulate in the longitudinal through duct, particularly in the region of the concave depression in the internal end section of this duct. Since the accumulation of cerumen and liquid secretions grows from the inside toward the outside, owing to the inward inclination of the branched duct 501, the cerumen and the secretions cannot get into the branched duct and reach the transducer 5 even in the case of great amounts of cerumen and secretions, whereby any damage to the transducer due to chemical action is effectively avoided. In the case of the longitudinal through duct becoming occluded, this duct can be easily and completely cleaned, by extracting the hearing aid and by using a suitable small brush, tube-brush, or the like, which is lead through the interior of the longitudinal through duct 401. The accumulated material can be pushed out of the end opposite to the end used for the insertion of a small brush or a cleaning implement into the longitudinal through duct. In this case, the small brush or the cleaning implement is advantageously inserted from the internal end of the ogival body 1 and directed toward the external end thereof, since owing to the inward inclination of the branched duct 501 communicating with the electro-acoustic transducer 5, there is no danger that part of the accumulated material may be driven into the branched duct 501 with a cleaning implement.

Advantageously, the side of the branched duct 501 which is turned toward the internal end of the ogival body 1 extends by a little distance into the interior of the longitudinal through duct 401, thus forming a deflecting wing 601. Therefore, both in the case of the growth of cerumen accumulation and during cleaning, the accumulated material is further deviated away from the branched duct 501.

Figure 4:
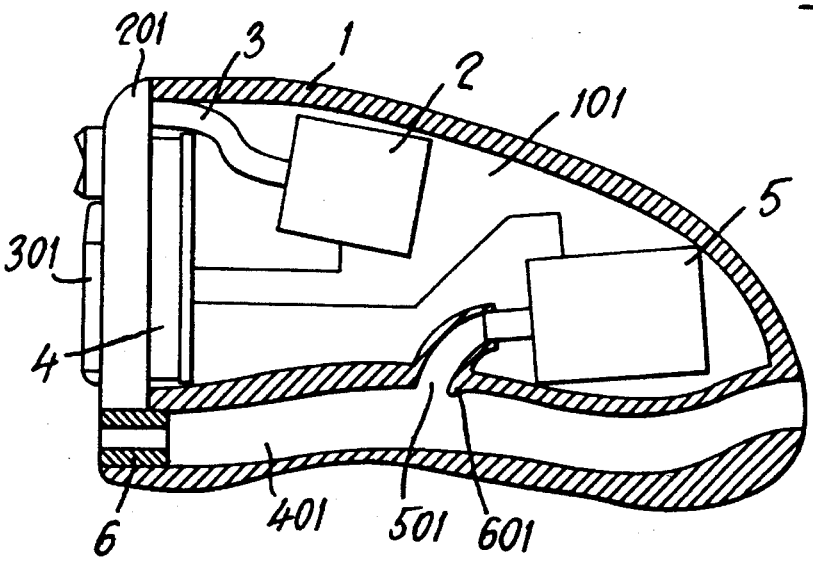
FIG. 4 shows an axial section similar to that of the preceding Figures of the in-the-ear hearing aid, combined with means for adjusting the mixing rate between acoustic signals received directly from the external environment by means of the longitudinal through duct, and acoustic signals transmitted to the user's ear by means of the hearing aid.

Referring to FIG. 1, the longitudinal through duct 401 can be kept always open. In this case, a mixing is obtained of the acoustic waves coming directly from the outside with the acoustic waves generated by the electro-acoustic transducer 5. As it appears from FIG. 4, the mixing rate between the directly transmitted acoustic waves and the acoustic waves generated by the electro-acoustic transducer 5 is adjustable and settable in dependence of the optimum requirements for a patient, by providing an element 6 for reducing or partly throttling the inlet cross-section of the longitudinal through duct 401, which element can be removably fastened, for example by shrinkage, by form-locking or by screwing, thanks to complementary tappings at the terminal zone of the opening of the longitudinal through duct 401, on the external end of the ogival body 1. When it is desired to eliminate the direct transmission of the acoustic waves to the eardrum, it is possible to provide a plug 7, for closing the opening at the external end of the longitudinal through duct 401. The plug 7 can be stably connected to the ogival body 1, for example by means of a flexible connection element 107, such as a string, a small bridge of material, or the like, whereby the danger of accidentally loosing the plug 7 is avoided.

Figure 3:
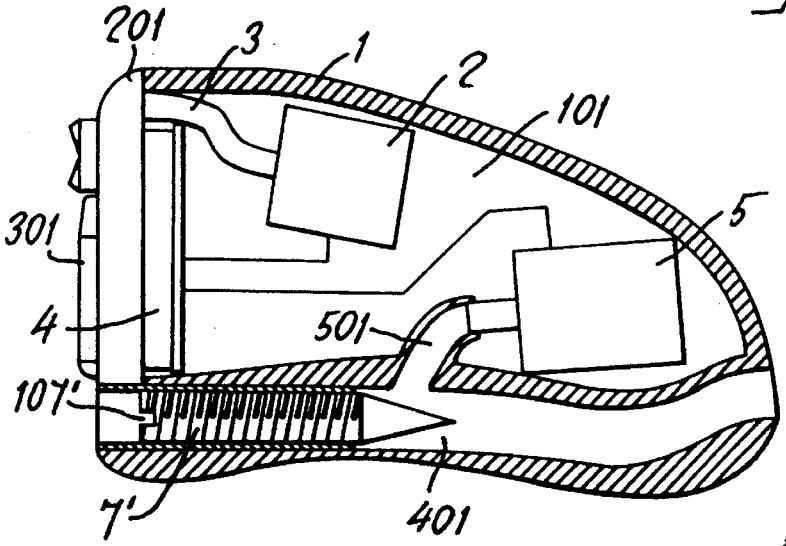
FIG. 3 shows an axial section similar to that of FIGS. 1 and 2 of the in-the-ear hearing aid, combined with means for varying the characteristic frequency of resonance.

In the outwardly closed condition, the longitudinal through duct 401 advantageously forms a resonance chamber for the acoustic waves emitted by the electro-acoustic transducer 5. With reference to FIG. 3, the plug 7' for the longitudinal through duct 401 may also constitute a tuning element for tuning the characteristic frequency of resonance in the cavity formed by the longitudinal through duct 401 on a range of frequencies requiring a differentiated gain, particularly an increased amplification relative to other frequency ranges. This may be an advantage when the frequency response of the ear varies depending on the frequency. In the example of FIG. 3, the plug 7' is formed by a threaded plug or pin thoroughly occluding the inner cross-section of the longitudinal through duct 401 and being screwed in an internal thread in the end section thereof at the external end of the ogival body, whereby it is possible to adjust the depth of the pin or of the plug penetration into the longitudinal through duct 401, thus varying the characteristic frequency of resonance. The end of the pin or of the plug is provided with means for clutching an implement, such as for example a diametral groove 107', by which it is possible to rotate the pin.

Obviously, a plurality of pins having a different length can be provided depending on the desired length of the longitudinal through duct 401, i.e. of the field of regulation for the characteristic frequency of resonance. One or more integrated elements (not shown) may be further provided which simultaneously perform not only the function of a plug but also the function of means for regulating the characteristic frequency of resonance and the function of means for mixing the directly transmitted acoustic waves with the acoustic waves transmitted by means of the hearing aid. For example, a threaded pin 7' may be formed with a coaxial hole of a predetermined diameter which is associable with a removable plug for closing this hole and/or with a plurality of means for reducing the diameter thereof.

I claim:

1. An in-the-ear hearing aid comprising:

an ogival body which is removably inserted into an acoustic meatus of an external ear of a user, said ogival body having a vertical cross-sectional shape of an ogive, an internal apex end and an external cut off end;

a microphone located in said ogival body which communicates with an external environment through the external end;

an amplifier located in said ogival body and having an input connected to said microphone and an output;

an electro-acoustic transducer connected to the output of said amplifier and having an output for acoustic waves which is directed toward the external end of said ogival body;

a housing for at least one battery which powers said microphone, said amplifier and said transducer;

a through duct extending through said body along a longitudinal axis from the internal end to the external end;

a branch duct communicating with the externally directed output of said transducer and with said through duct, said branch duct being branched off upwardly from said through duct and inclined relative to the longitudinal axis of said through duct toward the internal end of said ogival body.

2. The in-the-ear hearing aid as claimed in claim 1 wherein said branch duct is arcuate shaped with a downwardly facing concave curvature.

3. The in-the-ear hearing aid as claimed in claim 1 wherein a deflection wing is formed at an intersection of said branch duct and said through duct on a side of the intersection proximate to the internal end of said through duct, said deflection wing extending a small distance into said through duct so as to deviate any material accumulating in said through duct away from said branch duct.

4. The in-the-ear hearing aid as claimed in claim 1 wherein said through duct has a vertical cross-sectional shape which is undulated and approximately sinusoidal, the cross-sectional shape including (a) an intermediate convex portion vertically opposite an intersection of said branch duct with said through duct, (b) a concave depression located longitudinally between said intersection of said branch duct and the internal end of said through duct, and (c) a straight portion which is inclined downwardly at the external end of said through duct.

5. The in-the-ear hearing aid as claimed in claim 1 wherein said through duct is provided in a lower region of said ogival body.

6. The in-the-ear hearing aid as claimed in claim 1 wherein said through duct has an internal opening provided in a middle portion of the internal end of said ogival body.

7. The in-the-ear hearing aid as claimed in claim 1 and further including (a) a closing means for at least partially closing said through duct, and (b) an engaging means for removably engaging said closing means in an external end section of said through duct adjacent the external end of said ogival body.

8. The in-the-ear hearing aid as claimed in claim 7 wherein said closing means is a tubular insert.

9. The in-the-ear hearing aid as claimed in claim 7 wherein said closing means is an insert means for adjusting a characteristic frequency of resonance of said through duct.

10. The in-the-ear hearing aid as claimed in claim 9 wherein said engaging means includes an adjustment means for adjusting a longitudinal position of said insert means in said through duct whereby a length of a cavity of resonance formed by said through duct from an internal end of said insert means to the internal end of said ogival body is adjustable over a substantial portion of said through duct.

11. The in-the-ear hearing aid as claimed in claim 7 wherein said closing means is an insert means for adjusting a mixing rate of acoustic waves passing through said through duct from outside of said ogival body and acoustic waves from said transducer passing into said through duct from said branch duct.

12. The in-the-ear hearing aid as claimed in claim 7 wherein said closing means is an insert means for completely closing of said through duct.

13. The in-the-ear hearing aid as claimed in claim 7 wherein said closing means is selected from a group of separate insert means, said group of insert means including a first insert means for adjusting a characteristic frequency of resonance of said through duct, a second insert means for adjusting a mixing rate of acoustic waves passing through said through duct from outside of said ogival body and acoustic waves from said transducer passing into said through duct from said branch duct, and a third insert means for completely closing said through duct.

* * * * *

UNITED STATES PATENT AND TRADEMARK OFFICE

CERTIFICATE OF CORRECTION

PATENT NO. : 5,535,282

DATED : July 9, 1996

INVENTOR(S) : IN-THE-EAR HEARING AID

It is certified that error appears in the above-indentified patent and that said Letters Patent is hereby corrected as shown below:

Title page, item [19], inventor: should be--Racca--.
On the title page of the Letters Patent, please make the following correction:

item [75] Inventor: Luca Racca, Genoa, Italy

Signed and Sealed this

Twenty-fourth Day of September, 1996

*Attest:*

Bruce Lehman

BRUCE LEHMAN

*Attesting Officer*

*Commissioner of Patents and Trademarks*